United States Patent [19]

Süttinger et al.

[11] 4,456,182

[45] Jun. 26, 1984

[54] PULP GRINDER WITH LIQUID RETENTION

[75] Inventors: Richard Süttinger, Schongau; Ernst Böttger, Herbrechtingen-Eselsburg; Hans O. Henrich, Heidenheim; Theodor Bähr, Heidenheim; Helmut Thumm, Heidenheim, all of Fed. Rep. of Germany

[73] Assignee: J. M. Voith GmbH, Fed. Rep. of Germany

[21] Appl. No.: 327,437

[22] Filed: Dec. 4, 1981

[30] Foreign Application Priority Data

Dec. 13, 1980 [DE] Fed. Rep. of Germany ..... 3047033

[51] Int. Cl.[3] ..... B02C 19/12; B02C 23/36

[52] U.S. Cl. ..... 241/46.02; 241/46.04; 241/62; 241/282

[58] Field of Search ..... 241/21, 28, 62, 41, 241/46.02, 46 R, 65, 23, 282, 46.04

[56] References Cited

U.S. PATENT DOCUMENTS

| | | | |
|---|---|---|---|
| 1,132,258 | 3/1915 | Hall | 241/28 |
| 1,633,733 | 6/1927 | Fish, Jr. | 241/28 X |
| 1,936,843 | 11/1933 | Jonsson | 241/28 X |
| 2,929,568 | 3/1960 | Vawter . | |
| 4,305,590 | 12/1981 | Haikkala et al. | 241/28 X |

FOREIGN PATENT DOCUMENTS

| | | |
|---|---|---|
| 134130 | 7/1933 | Austria . |
| 445717 | 6/1927 | Fed. Rep. of Germany . |

*Primary Examiner*—Mark Rosenbaum

*Attorney, Agent, or Firm*—Ostrolenk, Faber, Gerb & Soffen

[57] ABSTRACT

The invention concerns a pulp grinder in which feed devices force the wood against the grinder stone and in which there is an elevated level of water in the grinding zone. Sealing devices or plates extend between the walls of the wood-supply chutes or pusher chambers and the grinder stone to keep the water level high only in the grinding zone. The sealing plates are adjustable for controlling the liquid level in the grinding zone.

5 Claims, 2 Drawing Figures

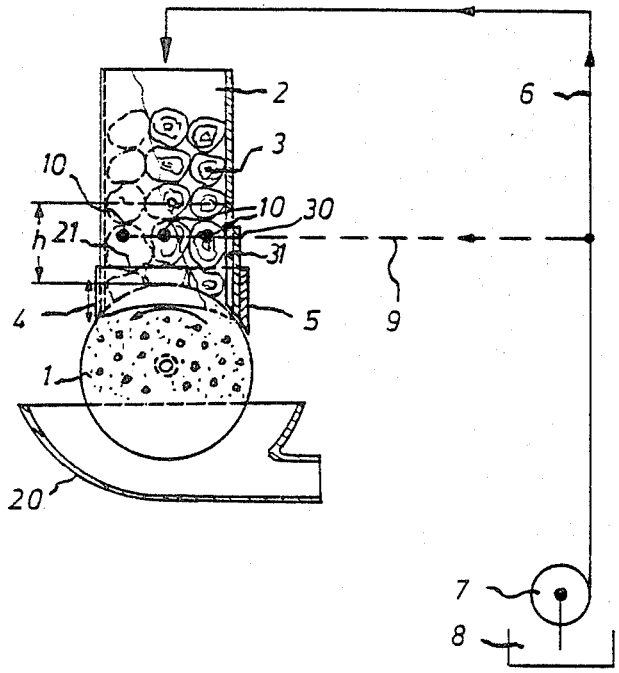
Fig. 1
Fig. 2
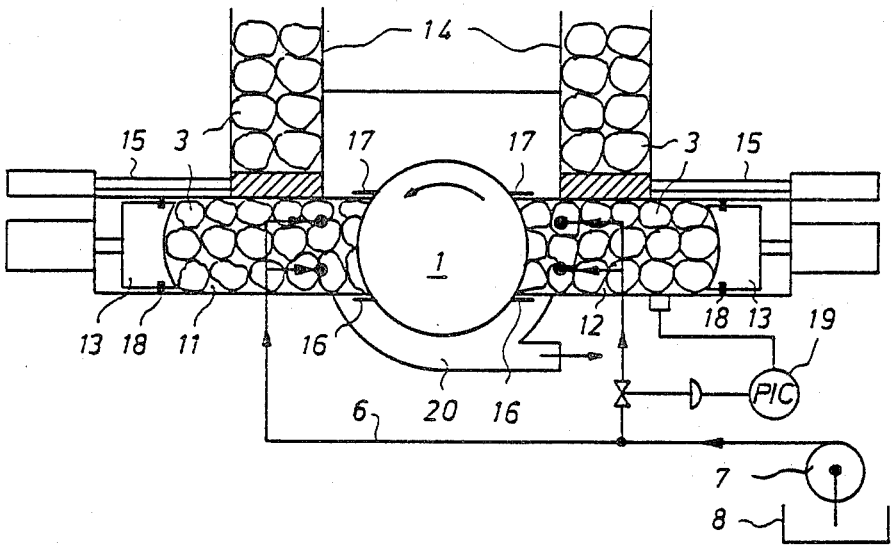

PULP GRINDER WITH LIQUID RETENTION

BACKGROUND OF THE INVENTION

The invention concerns a wood pulp grinder and particularly concerns means for retaining the pulp suspension forming liquid at the wood delivery area.

One such pulp grinder is known from German Pat. No. 445 717. This grinder is designed so that the wood can be soaked, preferably in warm water, directly in the wood-supply chute, rather than in a vat that is separate from the grinder housing. The patent specifies soaking the wood for one or even two hours in water in the wood-supply chute to obtain a satisfactory moisture content in the wood before it arrives at the grinder stone. It is obvious that the grinding must be very careful to attain such long soaking times in the supply chute, so that no damp should be expected in the grinding zone as a result of the heat generating by grinding.

Preventing the local overheating of the wood in the grinding zone by directing a stream of water onto it is also common in contemporary pulp grinders.

To ensure that there is a sufficient quantity of water in the grinding zone, it is known to supply water and/or to supplement the water in the grinding zone through passages in the grinder stone. See Austrian Pat. No. 134 130 and U.S. Pat. No. 2,929,568, for example.

SUMMARY OF THE INVENTION

The primary object of the invention is to provide a pulp grinder in which the heat generated by grinding is restored directly to the grinder water in the grinding zone or to the wood and in which grinding is carried out with as little grinder-stone friction as possible, which results in as much energy as possible being saved.

A related object is to retain the moisture for wetting the wood in the wood supply area.

These objects are achieved in accordance with the invention with a grinder adapted to hold water for wetting the wood to be ground in the delivery means which delivers the wood to the grinding zone. As with conventional pulp grinders, there is a grinding chamber in which a rotatable grinding stone is positioned for rotation about a generally horizontal axis. Wood is delivered to the grinding chamber and is pressed against the grinding stone for being ground. The grinding occurs in the presence of liquid, and particularly water, so that the grinding produces a liquid suspension of mechanical wood pulp. It is known to deliver the wood to the grinding stone directly from a wood delivery chute or to deliver it from a chute or supply box to a pressing means which presses the wood against the grinding stone to facilitate the grinding.

The wood being ground is to be supplied with the suspension forming liquid, and particularly water. According to the invention, the wood delivery means is provided with sealing means at the end of the delivery means that is located at the grinding stone for containing in the delivery means the suspension forming liquid which cooperates with the ground wood to produce the pulp suspension. The liquid is prevented from moving elsewhere out of the delivery means until it moves out with the ground wood.

Liquid supply means deliver liquid to the wood delivery means from a liquid source. The liquid can be introduced either through lines that empty into the neighborhood of the grinding zone or directly into the wood delivery chute or chutes from above or from the side.

This makes the invention especially simple with a continuous grinder.

The sealing means are adjustable in height, or in another way that would become apparent to one skilled in the art, for purposes of controlling the level of liquid in the delivery means. In particular, the sealing means may comprise a plurality of plates that extend from the end of the delivery means, i.e. the wood delivery chute or the pusher chamber if the wood is pushed to the grinder stone, which cover the short space between the end of the delivery means and the grinder stone. The adjustability of the sealing devices makes it possible on the one hand to compensate for wear on the grinder stone and on the other hand to regulate the height of the water level in the wood delivery chute.

The main suspension forming liquid used is essentially water. Boiling point-elevating agents can be added if necessary. Liquid consumption can be reduced by adding specific amounts of grinding suspension to it.

Furthermore, as it is contemplated that the temperature of the suspension forming liquid should be elevated for best results, the liquid being supplied to the delivery means may be first heated and may also be supplied with liquid boiling point elevating agents which permit the grinding to take place at elevated temperatures and which prevent the heat of grinding from unnecessarily boiling off the liquid.

With the invention, the evaporation of the liquid at the contact zone between the wood and the grinder stone, by applying a layer of moisture directly on the stone, will at least be extensively decreased. Rising bubbles of steam will cool and condense inside the layer of moisture.

The heat generated by grinding can be almost completely exploited for this purpose because little heat will escape outside the grinding zone. The sealing devices between the walls of the wood-supply chutes or the pusher chamber and the grinder stone will of course also keep the loss of liquid from the grinding zone very low.

Since only the bottom of the grinder stone will be immersed in the suspension of mechanical pulp, friction loss outside of the grinding zone will also be low. Considerable energy will thus be saved.

Another advantage of the invention is that hydrostatic pressure corresponding to the height of the column of liquid above the grinding zone is generated. This permits higher temperatures to be attained in the grinding zone, which helps to increase the quality of the mechanical pulp.

The invention can be employed, for example, both with continuous pulp grinders, which usually have supply chutes above the grinder stone, and with two-pusher or multiple pusher grinders, which have a corresponding number of pusher chambers each with a respective wood-supply chute with a piston pusher in it. With continuous grinders it is only necessary to supply enough liquid to the supply chute to ensure the presence of a column of water of the desired volume above the grinding zone. With two-pusher or multiple-pusher grinders, the only requirement is for each pusher chamber to be partly or completely filled with liquid, so that the liquid will fill up the spaces between the individual pieces of wood.

It is practical to be able to adjust the water level in the wood-supply chute so that it can be kept above the grinding zone. This will permit pressure and temperature to be adjusted to achieve the desired results.

Other objects and features of the invention are apparent from two embodiments of the invention described with reference to the accompanying drawings.

BRIEF DESCRIPTION OF THE DRAWINGS

FIG. 1 shows a continuous pulp grinder provided with the invention.

FIG. 2 shows a two-pusher pulp grinder provided with the invention.

DESCRIPTION OF THE PREFERRED EMBODIMENTS

Since the overall design and function of pulp grinders are known, it will be only summarily described in the following. The continuous grinder shown in FIG. 1 has a grinder chamber with a grinder stone 1 in it that is rotated around a horizontal axis by a drive mechanism that is not illustrated. The logs of wood to be pulped are placed in a wood-supply chute 2 above the grinder stone 1. Logs 3 are pressed down in a known manner by link chains, cog wheels, or similar devices not illustrated.

Wood-supply chute 2 is sealed to the grinder stone by a front sealing plate 4, a rear sealing plate 5, and lateral cover plates 21. These sealing plates extend from the end of the chute to the grinder stone. The heights of the front sealing plate 4, from under which the mechanical pulp emerges, of the rear sealing plate 5, and of the lateral sealing plates are all adjustable for maintaining and adjusting the liquid level in the chute. Especially the front sealing plate, and perhaps the others as well, is flexible enough that it will deflect to permit ground wood and chips to move out of the chute, yet is resilient and strong enough to maintain the desired seal.

Liquid is supplied to a level above the grinding zone through a line 6 that is supplied with liquid from a reservoir 8 by a pump 7. Water may be employed for the liquid and its temperature can be raised through the addition of heated liquids. For better pulp suspension formation, a higher water or liquid temperature is desirable. Boiling point raising chemicals may be added to the liquid, enabling grinding at higher liquid temperatures. Water can be supplied into wood-supply chute 2 but also through a line 9, indicated by the dashed line, with nozzles 10 at the end directly into the grinding zone. The liquid level can, as illustrated, be at a height h above the grinding zone, or the supply chute can if necessary be filled to the top with liquid.

FIG. 2 schematically shows a two-pusher grinder. It also has a grinder stone 1 positioned between two pusher chambers 11 and 12 that contain the logs 3 to be ground.

Piston pushers 13, which are generally hydraulically activated, push logs 3 across the chutes or storage boxes 14 and against the grinder stone 1. Logs 3 are supplied from respective storage boxes 14, which communicate individually with the grinder chambers 11 or 12 to supply each with wood. After the wood has been supplied, each storage box can be blocked off with a respective closure 15, which is a slide activated by a hydraulic cylinder.

To produce a layer of water in the grinding zone, both pusher chambers 11 and 12 are either partly or preferably completely filled with liquid. To do this, it is necessary only to provide both chambers with appropriate sealing devices 16 and if necessary 17. The same is true of lateral sealing. The sealing devices are also designed to be adjustable. These sealing devices are of the same type as those in FIG. 1. Both pusher pistons 13 have sealing rings 18 which are also sealing devices for the wood delivery means.

The liquid is also supplied from a line 6 into the pusher chambers 11 and 12 by a pump 7 that takes the liquid from a reservoir 8.

To maintain the desired level of liquid or an appropriate hydrostatic pressure and to adjust them, a system involving a pressure transducer 19 can be employed.

The mechanical pulp can be extracted from a collection pit 20 underneath the grinder stone 1.

In FIG. 1 is additionally shown at least one downwardly directed channel 31 machined into the inner surface of a plate 30, defining the right wall (at the leading edge of the walls of the wood-supply chute) at the lower part of the wood-supply chute 2, which is provided for the in any case assured delivery of water (grinding liquid) to the grinding surface of the grinding stone. Such channels may be also provided by a corrugated surface of the plate 30 or walls of the chute 2 and also throughout all the four sides of the chute.

The channels 31 may like wise be provided in the pusher chambers 11 and 12 of FIG. 2.

Although the present invention has been described in connection with a plurality of preferred embodiments thereof, may variations and modifications will now become apparant to those skilled in the art. It is preferred, therefore, that the present invention be limited not by the specific disclosure herein, but only by the appended claims.

What is claimed is:

1. A wood pulp grinder, comprising:

a grinding chamber; an abrasive grinder stone in the grinding chamber and the stone being movable in the grinding chamber for grinding wood in contact with the grinder stone;

wood delivery means for containing and delivering wood to the grinder stone for grinding; the wood delivery means comprising a wood supply chute which at the grinder stone is defined by front and rear circumferentially spaced apart sealing plates and by lateral cover plates wrapped around the grinder stone and extending between the sealing plates; the wood delivery means is also to be for containing liquid therein in the presence of which the wood is to be ground;

the sealing and cover plates being sealed to the grinder stone for defining sealing means between the wood delivery means and the grinder stone for retaining liquid in the delivery means and for holding the liquid at an elevated level only in the delivery means above the bottom of the wood delivery means, while permitting the liquid in the wood delivery means to move out with the ground wood; the liquid at an elevated level in the wood delivery means being for retaining heat generated during the grinding operation within the grinding chamber and for applying hydrostatic pressure at the grinder stone for enabling higher temperature to be attained at the grinder stone.

2. The wood pulp grinder of claim 1, further comprising liquid supply means for supplying liquid to the delivery means.

3. The wood pulp grinder of claim 2, wherein the liquid supply means also supplies liquid boiling point elevating agents.

4. The wood pulp grinder of either of claims 1 or 2, wherein the sealing means are adjustable for controlling the level of liquid in the delivery means.

5. The wood pulp grinder of claim 1, further comprising a wood pusher, and means for moving the pusher across the chute for engaging wood in the chute and pressing the wood against the grinder stone.

* * * * *